US006924771B2

(12) United States Patent
Li et al.

(10) Patent No.: US 6,924,771 B2
(45) Date of Patent: Aug. 2, 2005

(54) MULTI-MEANDERED ANTENNAS WITH MULTIPLE BANDS AND SINGLE INPUT

(75) Inventors: Hsueh-Jyh Li, Taipei (TW); Chang-Fa Yang, Hsin Chung (TW); Jen-Hsun Li, Taipei (TW)

(73) Assignee: Yen Tjing Ling Industrial Development Foundation, Taipei (TW)

( * ) Notice: Subject to any disclaimer, the term of this patent is extended or adjusted under 35 U.S.C. 154(b) by 15 days.

(21) Appl. No.: 10/617,778

(22) Filed: Jul. 14, 2003

(65) Prior Publication Data

US 2004/0012537 A1 Jan. 22, 2004

(30) Foreign Application Priority Data

Jul. 16, 2002 (TW) ..... 91115782 A

(51) Int. Cl.[7] ..... H01Q 1/32
(52) U.S. Cl. ..... 343/713
(58) Field of Search ..... 343/895, 713, 343/722, 725, 700 MS

(56) References Cited

U.S. PATENT DOCUMENTS 6,198,442 B1 * 3/2001 Rutkowski et al. ..... 343/702
6,204,826 B1 * 3/2001 Rutkowski et al. ..... 343/895
6,424,300 B1 * 7/2002 Sanford et al. ..... 343/702
2002/0123312 A1 * 9/2002 Hayes et al. ..... 455/90

* cited by examiner

*Primary Examiner*—Don Wong
*Assistant Examiner*—Minh Dieu A
(74) *Attorney, Agent, or Firm*—Troxell Law Office, PLLC

(57) ABSTRACT

A multi-meandered antenna with multiple bands and single input to be used in a vehicle wireless communication environment that includes an input end, coupled to a metal body of the vehicle for getting wireless signals, and at least one meandered antenna, coupled to the input end for transmitting or receiving said wireless signals. The multi-meandered antenna with multiple bands and single input meets the various wireless communication requirements of the vehicle after combining.

20 Claims, 5 Drawing Sheets

MULTI-MEANDERED ANTENNAS WITH MULTIPLE BANDS AND SINGLE INPUT

FIELD OF THE INVENTION

The present invention relates generally to multi-meandered antennas with multiple bands and single input. More particularly, the present invention relates to multi-meandered antennas with multiple bands and single input used in a vehicle suitable for wireless communications, such as AM/FM Broadcasting, Digital Audio Broadcasting (DAB), Television, Cellular Phone equipments, etc.

BACKGROUND OF THE INVENTION

Today, more and more vehicle manufacturers adopt printed antennas on glass windows to replace the traditional monopole rod antenna. The printed antenna on the glass of the vehicle can prevent the antenna from damage and reduce the resistance and noises generated by winds on the rod antenna while driving the vehicle. In addition to traditional AM/FM broadcasting bands, the printed antenna may further comprise Digital Audio Broadcasting (DAB), Television, and GSM bands. However, most of the printed antennas used by the vehicle of the prior art are designed for some specific communication equipments, such as the AM/FM radio. Thus, multi-band antennas are needed in vehicles for using AM/FM, DAB, television, cellular phone equipments, etc.

SUMMARY OF THE INVENTION

The present invention of the multi-meandered antennas with multiple bands and single input can be applied in a vehicle for using AM/FM, DAB, television, cellular phone equipments, etc. The multi-meandered antenna includes the following: an input end, coupled to the metal body of the vehicle and connected to receiving or transmitting devices through a cable; at least one meandered antenna, connected to the input end for receiving or transmitting the wireless signals to air; whereby, the multi-meandered antenna with multiple bands and single input may satisfy various requirements for wireless communications in the vehicle.

The novel features of the invention are set forth with particularity in the appended claims. This invention may be best understood from the following descriptions together with associated figures.

DESCRIPTION OF THE PREFERRED EMBODIMENTS

Figure 1:
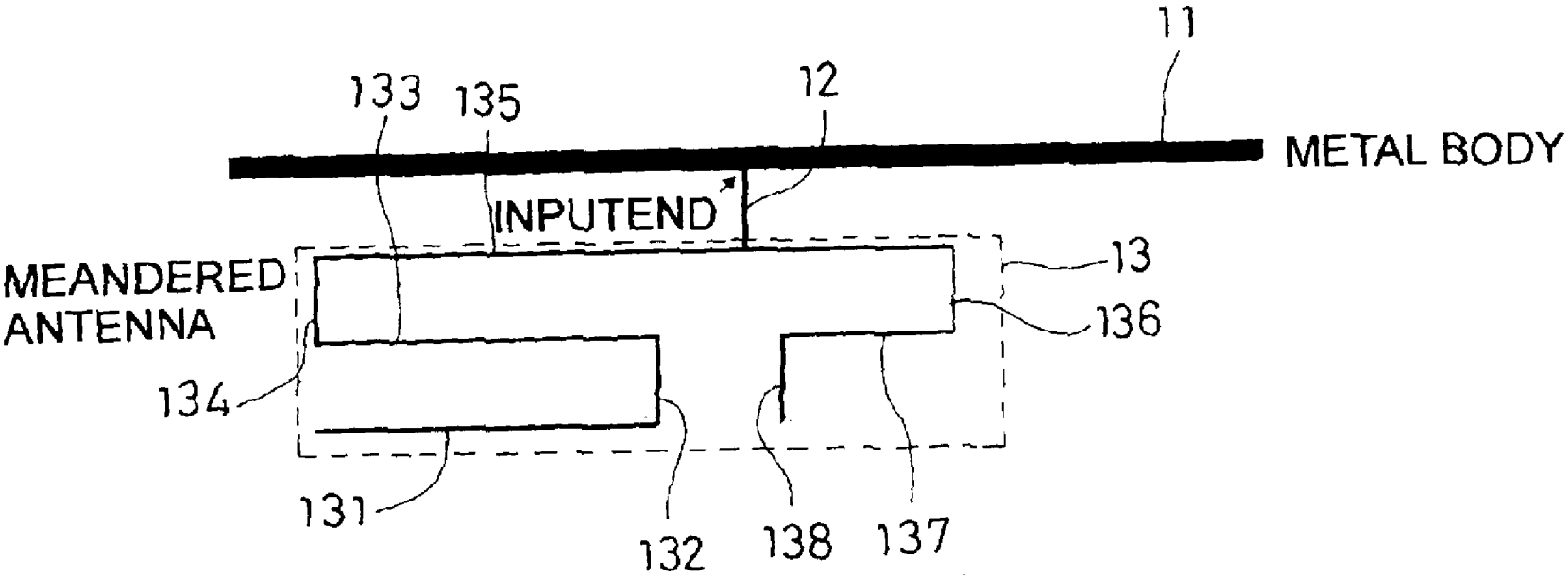
FIG. 1 shows a block diagram of a multi-meandered antenna with multiple bands and single input in accordance with one embodiment of the present invention.

Referring to FIG. 1 shows a block diagram of a multi-meandered antenna with multiple bands and single input in accordance with one embodiment of the present invention. As shown in FIG. 1, the multi-meandered antenna with multiple bands and single input of the present invention comprises: an input end 12 and at least one meandered antenna 13.

Wherein, one end of the input end 12 is coupled to a metal body 11 of the vehicle for getting a wireless signal and another end is coupled to the at least one meandered antenna 13 for receiving the various wireless signals. The present invention combining the at least one meandered antenna 13 to form a multi-meandered antenna 13 for receiving various multi-band wireless signals received from the input end 12 to satisfy the various wireless communication requirements such as AM/FM broadcasting, television, digital audio broadcasting and mobile communications of the vehicle.

Wherein, the shape of the at least one meandered antenna 13 is: the first end of the meandered antenna 13 extending right a first horizontal segment 131 and extending upward a first vertical segment 132, extending left a second horizontal segment 133 and extending upward a second vertical segment 134, extending right a third horizontal segment 135 and extending downward a third vertical segment 136, and extending left a fourth horizontal segment 137 and extending downward a fourth vertical segment 138. Wherein, the lengths of the first vertical segment 132, the second vertical segment 134, the third vertical segment 136 and the fourth vertical segment 138 are equal and the length of the third horizontal segment 135 is greater than the length of the first horizontal segment 131 and greater than the length of the fourth horizontal segment 137 and the input end 12 is fed into the right side of the third horizontal segment 135 at about ⅓ length.

Figure 2:
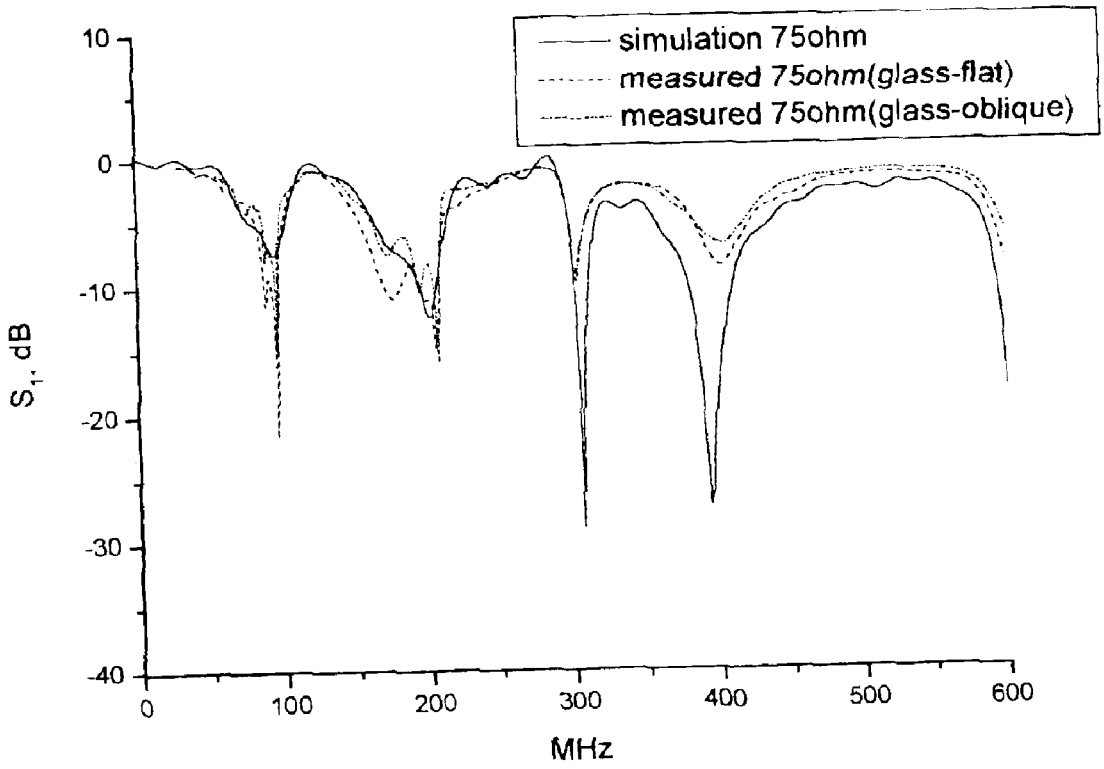
FIG. 2 shows a diagram of the return loss simulations and measurements for the multi-meandered antenna in accordance with the embodiment of the present invention given in FIG. 1.

Referring to FIG. 2 shows a diagram of the return loss simulations and measurements of the multi-meandered antenna in accordance with one embodiment of the present invention. As shown in FIG. 2, the multi-meandered antenna 13 with multiple bands and single input in accordance with one embodiment of the present invention has very small return loss at the 100 MHz, 200 MHz, 300 MHz, 400 MHz and 600 MHz frequencies. This indicates that the multi-meandered antenna 13 of the present invention printed on windows of the vehicle having the feature of multi-band performances.

Figure 3:
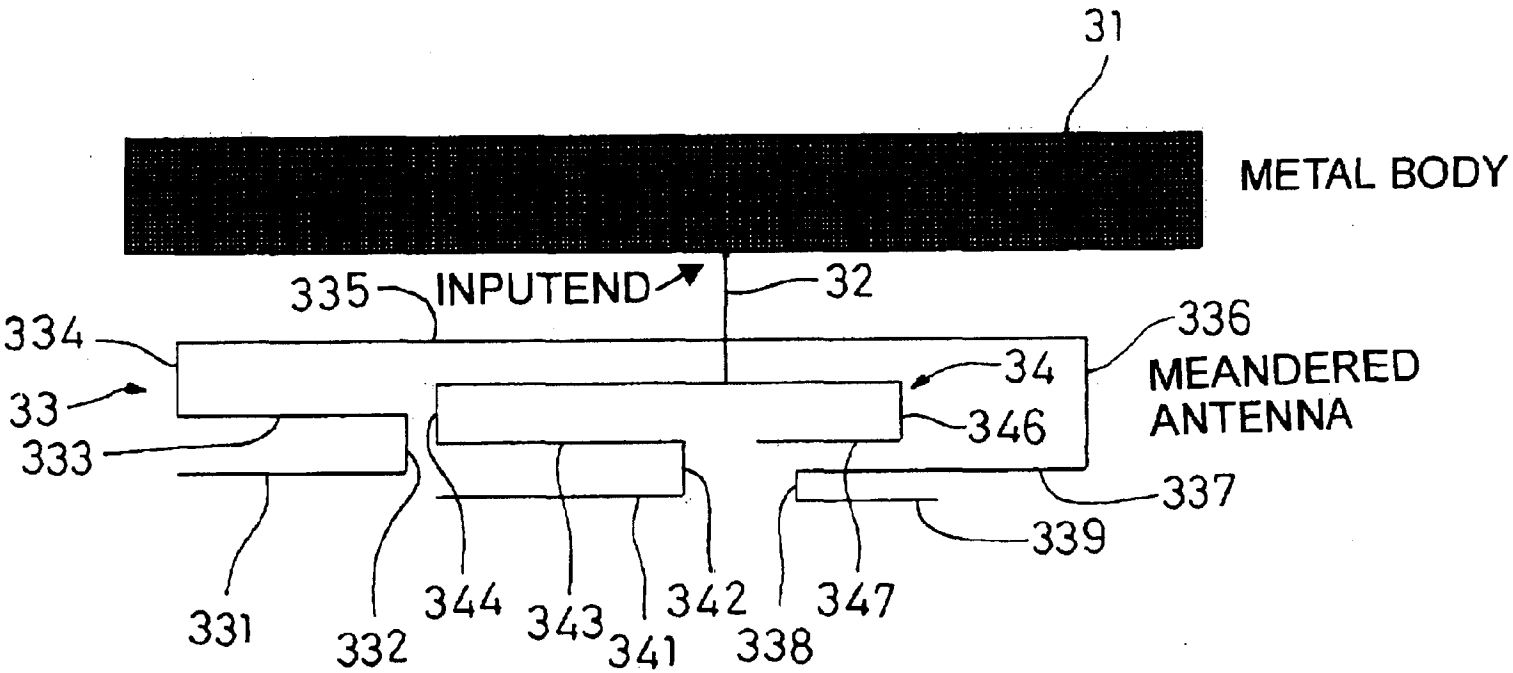
FIG. 3 shows a block diagram of a multi-meandered antenna with multiple bands and single input in accordance with a second embodiment of the present invention.

Referring to FIG. 3 shows a block diagram of a multi-meandered antenna with multiple bands and single input in accordance with another embodiment of the present invention. As shown in FIG. 3, the multi-meandered antenna with multiple bands and single input of the present invention comprises: an input end 32, a first meandered antenna 33 and a second meandered antenna 34.

Wherein, one end of the input end 32 is coupled to a metal body 31 of the vehicle and another end is coupled to the first meandered antenna 33 and second meandered antenna 34 for transmitting or receiving the various wireless signals. The present invention combining the first meandered antenna 33 and second meandered antenna 34 to form a multi-meandered antenna 33 for transmitting or receiving various multi-band wireless signals from the input end 32 to satisfy the various wireless communication requirements such as AM/FM broadcasting, television, digital audio broadcasting, mobile communications of the vehicle.

Wherein, the shape of the first meandered antenna 33 is: the first end of the first meandered antenna 33 extending right a first horizontal segment 331 and extending upward a first vertical segment 332, extending left a second horizontal segment 333 and extending upward a second vertical segment 334, extending right a third horizontal segment 335 and extending downward a third vertical segment 336, extending left a fourth horizontal segment 337 and extending downward a fourth vertical segment 338 and extending right a fifth horizontal segment 339. Wherein, the length of the third horizontal segment 335 is greater than the length of the fourth horizontal segment 337 and greater than the length of the first horizontal segment 331 and greater than the length of the fifth horizontal segment 339 and the lengths of the first horizontal segment 331 and the second horizontal segment 333 are equal. Wherein, the length of the third vertical segment 336 is greater than the length of the second vertical segment 334 and greater than the length of the first vertical segment 332 and greater than the length of the fourth vertical segment 338 and the input end 32 is fed into the right side of the third horizontal segment 335 at about ⅓ length.

Wherein, the shape of the second meandered antenna 34 is: the first end of the second meandered antenna 34 extending right a first horizontal segment 341 and extending upward a first vertical segment 342, extending left a second horizontal segment 343 and extending upward a second vertical segment 344, extending right a third horizontal segment 345 and extending downward a third vertical segment 346 and extending left a fourth horizontal segment 347. Wherein, the lengths of the first vertical segment 342, second vertical segment 344 and third vertical segment 346 are equal and the length of the third horizontal segment 345 is greater than the length of the first horizontal segment 341 and greater than the length of the fourth horizontal segment 347 and the input end 32 is fed into the right side of the third horizontal segment 345 at about ⅓ length.

Figure 4:
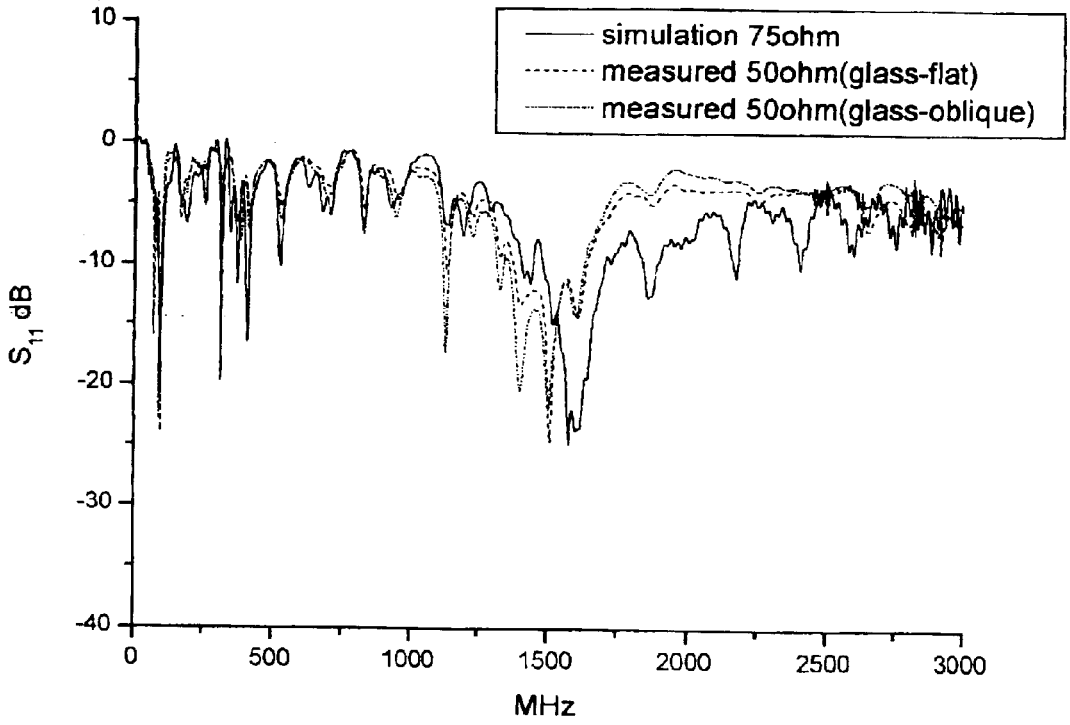
FIG. 4 shows a diagram of the return loss simulations and measurements for the multi-meandered antenna in accordance with the embodiment of the present invention given in FIG. 3.

Referring to FIG. 4 shows a diagram of the return loss simulations and measurements of the multi-meandered antenna in accordance with another embodiment of the present invention. As shown in FIG. 4, the multi-meandered antenna 33 with multiple bands and single input in accordance with another embodiment of the present invention has very small return loss at the 100 MHz, 300 MHz, 400 MHz and 1500 MHz frequencies. This indicates that the multi-meandered antennas 33 and 34 of the present invention printed on windows of the vehicle having the feature of multi-band performances.

Figure 5:
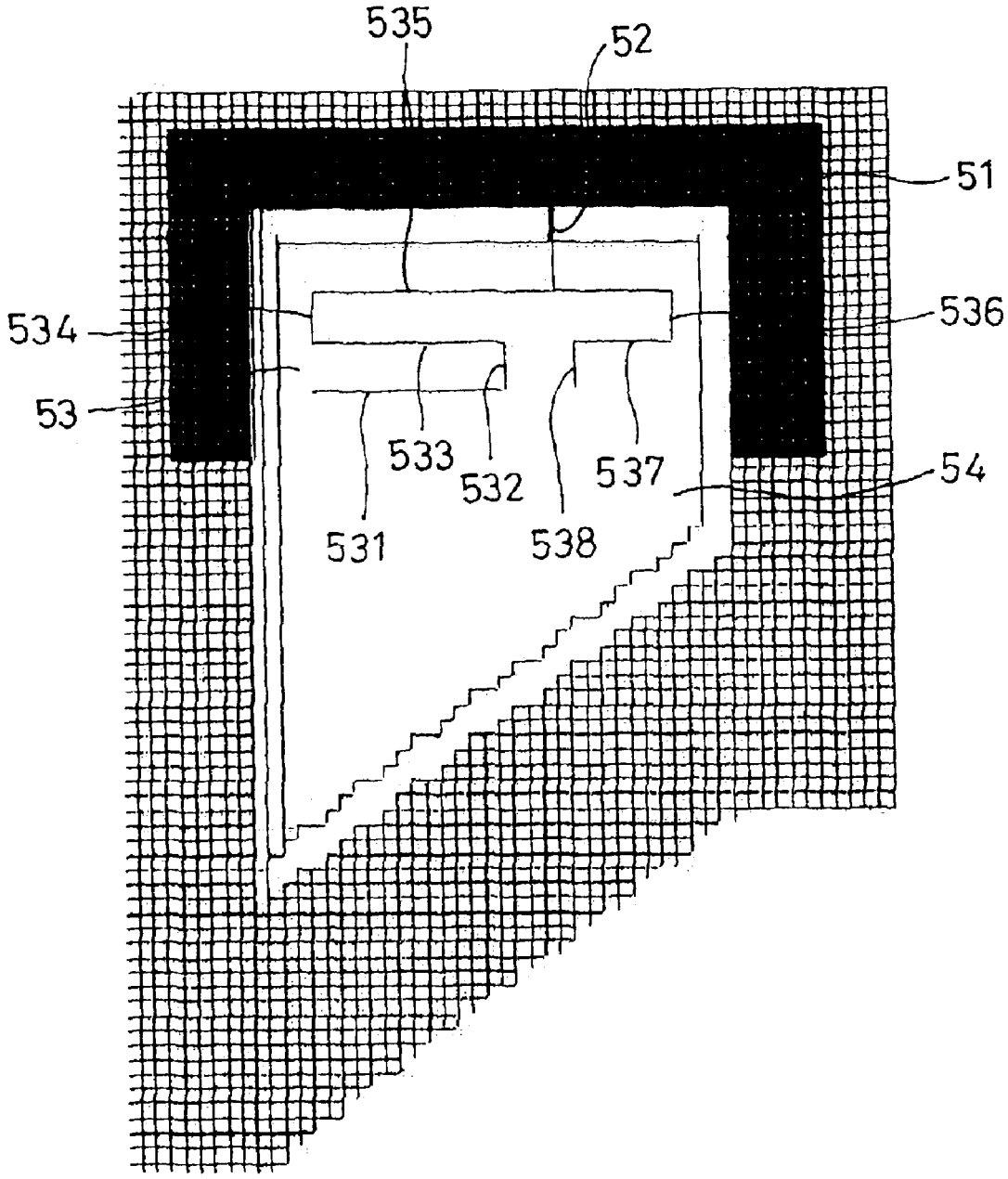
FIG. 5 shows a block diagram of a multi-meandered antenna with multiple bands and single input in accordance with a third embodiment of the present invention.

Referring to FIG. 5 shows a block diagram of a multi-meandered antenna with multiple bands and single input in accordance with the other embodiment of the present invention. As shown in FIG. 5, the multi-meandered antenna with multiple bands and single input of the present invention comprises: an input end 52, at least one meandered antenna 53 and a loop antenna 54.

Wherein, the input end 52 is coupled to a metal body 51 of the vehicle for getting a wireless signal, the at least one meandered antenna 53 is coupled to the input end 52 for transmitting or receiving the various wireless signals, and the loop antenna 54 is coupled to the input end 52 and enclose the at least one meandered antenna 53 inside. The present invention combines the at least one meandered antenna 53 and the loop antenna 54 for transmitting or receiving various multi-band wireless signals to satisfy the various wireless communication requirements such as AM/FM broadcasting, television, digital audio broadcasting and mobile communications of the vehicle.

Wherein, the shape of the at least one meandered antenna 53 is: the first end of the meandered antenna 53 extending right a first horizontal segment 531 and extending upward a first vertical segment 532, extending left a second horizontal segment 533 and extending upward a second vertical segment 534, extending right a third horizontal segment 535 and extending downward a third vertical segment 536, and extending left a fourth horizontal segment 537 and extending downward a fourth vertical segment 538. Wherein, the lengths of the first vertical segment 532, the second vertical segment 534, the third vertical segment 536 and the fourth vertical segment 538 are equal and the lengths of the first horizontal segment 531 and second horizontal segment 533 are equal. Wherein, the length of the third horizontal segment 535 is greater than the length of the first horizontal segment 531 and greater than the length of the fourth horizontal segment 537 and the input end 52 is fed into the right side of the third horizontal segment 53 at about ⅓ length.

While the invention has been described with reference to a preferred embodiment thereof, it is to be understood that modifications or variations may be easily made without departing from the spirit of this invention, which is defined by the appended claims.

What is claimed is:

1. A multi-meandered antenna with multiple bands and single input using in a vehicle wireless communication environment, comprises:

an input end, coupled to a metal body of said vehicle for getting a wireless signal; and at least one meandered antenna, coupled to said input end for transmitting or receiving said wireless signal;

whereby, said multi-meandered antenna with multiple bands and single input can satisfy the various wireless communication requirements of said vehicle after combining, wherein the shape of said meandered antenna includes a first end extending right a first horizontal segment and extending upward a first vertical segment, extending left a second horizontal segment and extending upward a second vertical segment, extending right a third horizontal segment and extending downward a third vertical segment, and extending left a fourth horizontal segment and extending downward a fourth vertical segment.

2. A multi-meandered antenna with multiple bands and single input as claimed in claim 1, wherein the lengths of said first vertical segment, said second vertical segment, said third vertical segment and said fourth vertical segment are equal.

3. A multi-meandered antenna with multiple bands and single input as claimed in claim 1, wherein the lengths of said first horizontal segment and said second horizontal segment are equal.

4. A multi-meandered antenna with multiple bands and single input as claimed in claim 1, wherein said input fed into the right side of said third horizontal segment at about ⅓ length.

5. A multi-meandered antenna with multiple bands and single input as claimed in claim 1, wherein the lengths of said third horizontal segment is greater than the length of said first horizontal segment arid greater than the length of said fourth horizontal segment.

6. A multi-meandered antenna with multiple bands and single input using in a vehicle wireless communication environment, comprises:

an input end, coupled to a metal body of said vehicle for getting a wireless signal; and at least one meandered antenna, coupled to said input end for transmitting or receiving said wireless signal;

whereby, said multi-meandered antenna with multiple bands and single input can satisfy the various wireless communication requirements of said vehicle after combining, wherein said at least one meandered antenna further comprises a first meandered antenna and a second meandered antenna, wherein the shape of said first meandered antenna is: the first end of said first meandered antenna extending right a first horizontal segment and extending upward a first vertical segment, extending left a second horizontal segment and extending upward a second vertical segment, extending right a third horizontal segment and extending downward a third vertical segment, extending left a fourth horizontal segment and extending downward a fourth vertical segment and extending right a fifth horizontal segment.

7. A multi-meandered antenna with multiple bands and single input as claimed in claim 6, wherein the lengths of said first horizontal segment and said second horizontal segment are equal.

8. A multi-meandered antenna with multiple bands and single input as claimed in claim 6, wherein the lengths of said third vertical segment is greater than the length of said second vertical segment and greater than the length of said first vertical segment and greater than the length of said fourth vertical segment.

9. A multi-meandered antenna with multiple bands and single input as claimed in claim 6, wherein the length of said third horizontal segment is greater than the length of said fourth horizontal segment and greater than the length of said first horizontal segment and greater than the length of said fifth horizontal segment.

10. A multi-meandered antenna with multiple bands and single input as claimed in claim 6, wherein said input end is fed into the right side of said third horizontal segment at about ⅓ length.

11. A multi-meandered antenna with multiple bands and single input using in a vehicle wireless communication environment, comprises:

an input end, coupled to a metal body of said vehicle for getting a wireless signal; and at least one meandered antenna, coupled to said input end for transmitting or receiving said wireless signal;

whereby, said multi-meandered antenna with multiple bands and single input can satisfy the various wireless communication requirements of said vehicle after combining, wherein said at feast one meandered antenna further comprises a first meandered antenna and a second meandered antenna, wherein the shape of said second meandered antenna is: the first end of said second meandered antenna extending right a first horizontal segment and extending upward a first vertical segment, extending left a second horizontal segment and extending upward a second vertical segment, extending right a third horizontal segment and extending downward a third vertical segment and extending left a fourth horizontal segment.

12. A multi-meandered antenna with multiple bands and single input as claimed in claim 11, wherein the lengths of said first horizontal segment and said second horizontal segment are equal.

13. A multi-meandered antenna with multiple bands and single input as claimed in claim 11, the lengths of said first vertical segment, said second vertical segment and said third vertical segment are equal.

14. A multi-meandered antenna with multiple bands and single input as claimed in claim 11, wherein the length of said third horizontal segment is greater than the length of said first horizontal segment and greater than the length of said fourth horizontal segment.

15. A multi-meandered antenna with multiple bands and single input as claimed in claim 11, wherein said input end is fed into the right side of said third horizontal segment at about ⅓ length.

16. A multi-meandered antenna with multiple bands and single input using in a vehicle wireless communication environment, comprises:

an input end, coupled to a metal body of said vehicle for getting a wireless signal;

at least one meandered antenna, coupled to said input end for transmitting or receiving said wireless signal; and a loop antenna, coupled to said input end for enclosing said meandered antenna therein;

whereby, said multi-meandered antenna with multiple bands and single input can satisfy the various wireless communication requirements of said vehicle by combining said meandered antenna with said loop antenna, wherein the shape of said meandered antenna is: the first end of said meandered antenna extending right a first horizontal segment and extending upward a first vertical segment, extending left a second horizontal segment and extending upward a second vertical segment, extending right a third horizontal segment and extending downward a third vertical segment, and extending left a fourth horizontal segment and extending downward a fourth vertical segment.

17. A multi-meandered antenna with multiple bands and single input as claimed in claim 16, wherein the lengths of said first vertical segment, said second vertical segment, said third vertical segment and said fourth vertical segment are equal.

18. A multi-meandered antenna with multiple bands and single input as claimed in claim 16, wherein the lengths of said first horizontal segment and said second horizontal segment are equal.

19. A multi-meandered antenna with multiple bands and single input as claimed in claim 16, wherein said input end is fed into the right side of said third horizontal segment at about ⅓ length.

20. A multi-meandered antenna with multiple bands and single input as claimed in claim 16, wherein the length of said third horizontal segment is greater than the length of said first horizontal segment and greater than the length of said fourth horizontal segment.

* * * * *